US008394341B2

(12) United States Patent
Reinhardt et al.

(10) Patent No.: US 8,394,341 B2
(45) Date of Patent: Mar. 12, 2013

(54) MICROFLUIDIC CHIP FRAME

(75) Inventors: Thomas Reinhardt, Karlsruhe (DE); Martin Baeuerle, Buehlertal (DE)

(73) Assignee: Agilent Technologies, Inc., Santa Clara, CA (US)

( * ) Notice: Subject to any disclaimer, the term of this patent is extended or adjusted under 35 U.S.C. 154(b) by 1961 days.

(21) Appl. No.: 11/070,811

(22) Filed: Mar. 2, 2005

(65) Prior Publication Data

US 2005/0201902 A1 Sep. 15, 2005

Related U.S. Application Data

(63) Continuation-in-part of application No. PCT/EP2004/050270, filed on Mar. 8, 2004.

(51) Int. Cl.
*B05B 5/00* (2006.01)

(52) U.S. Cl. ..... 422/508; 422/502; 422/503; 422/504; 239/690

(58) Field of Classification Search ..... 422/502–504, 422/508; 239/690
See application file for complete search history.

(56) References Cited

U.S. PATENT DOCUMENTS

| | | | | |
|---|---|---|---|---|
| 4,476,149 | A * | 10/1984 | Poppe et al. | 427/2.13 |
| 5,009,533 | A * | 4/1991 | Kageyama | 401/65 |
| 5,500,071 | A | 3/1996 | Kaltenbach et al. | 156/272.8 |
| 6,048,498 | A | 4/2000 | Kennedy | 422/99 |
| 6,495,104 | B1 | 12/2002 | Unno et al. | 422/68.1 |
| 6,663,837 | B1 | 12/2003 | Belmont | 422/104 |
| 7,303,726 | B2 * | 12/2007 | McAllister et al. | 422/68.1 |
| 2003/0083686 | A1 * | 5/2003 | Freeman et al. | 606/181 |
| 2003/0223906 | A1 * | 12/2003 | McAllister et al. | 422/58 |
| 2004/0113068 | A1 * | 6/2004 | Bousse et al. | 250/288 |
| 2004/0186394 | A1 * | 9/2004 | Roe et al. | 600/583 |

FOREIGN PATENT DOCUMENTS

DE 101 22 457 11/2002

OTHER PUBLICATIONS

Office Action Dated July 23, 2012 Issued in Corresponding European Patent Application Serial No. 05100768.0.

* cited by examiner

*Primary Examiner* — In Suk Bullock
*Assistant Examiner* — Paul Hyun

(57) ABSTRACT

A frame for a microfluidic chip may be used together with a laboratory apparatus. The frame is adapted at least for one of the following features: receiving the microfluidic chip; protecting the microfluidic chip; and, positioning the microfluidic chip relative to the frame. The microfluidic chip is movable relative to the frame.

24 Claims, 10 Drawing Sheets

MICROFLUIDIC CHIP FRAME

This is a continuation in part of International Application No. PCT/EP2004/050270, filed 8 Mar. 2004.

BACKGROUND ART

The present invention relates generally to microfluidic laboratory technology for chemical, physical, and/or biological analysis or synthesis of substances on a substrate with a microfluidic structure. It relates in particular to handling substrates with microfluidic structure.

Efforts in the field to miniaturize separation systems such as liquid chromatography and capillary electrophoresis systems are high because such miniaturized systems generally provide improved performance characteristics. This results in reduced production and analysis costs. Due to miniaturization the expenditure of coupling and handling the devices increases. Especially handling microfluidic chips with a complex fluidic channel system demands increasing efforts. Known in the art are glass chips fixedly glued on a plastic carrier as disclosed for example in the U.S. Pat. No. 6,495,104 B1. Another approach is to implement the miniaturized fluidic channel structure on flexible chips as disclosed in the U.S. Pat. No. 5,500,071. Used for separation such microfluidic chips normally comprise very sensitive parts, which can be easily destroyed if touched by mistake. In addition, the flexibility of the material complicates handling and positioning before coupling these microfluidic chips with a laboratory apparatus, for example a mass spectrometer. DE 100 122457 A1 discloses a container for an analytical chip. U.S. Pat. No. 6,663,837 discloses a housing box for electronic chip with biological probes. A microfluidic device is known from U.S. Pat. No. 6,048,498.

DISCLOSURE OF THE INVENTION

It is an object of the invention to provide an improved handling of a microfluidic chip. The object is solved by the independent claims. Preferred embodiments are shown by the dependent claims.

According to embodiments of the present invention, the objects indicated are achieved by a frame for a microfluidic chip, which can be used together with a laboratory apparatus. The frame is characterized by one or more of the following features: The frame is adapted for receiving the microfluidic chip or for protecting the microfluidic chip or for positioning the microfluidic chip relatively to the frame. The frame is adapted for permitting the microfluidic chip moving relatively to the frame. Advantageously, very sensitive parts of the microfluidic chip can be protected during handling, storage, and transport. The frame can be touched and stored without destroying the sensitive parts of the microfluidic chip. Coupling with a laboratory apparatus such as a mass spectrometer, e.g., becomes easier. Additionally an exact and repeatable positioning process of the microfluidic chip relatively to the frame can be guaranteed. This also enables the exact positioning of the chip into a laboratory apparatus if the frame is positioned precisely in the laboratory apparatus.

Besides this, embodiments of the invention relate to a miniaturized microfluidic device comprising a microfluidic chip and a frame. The device can be used to inject liquid safely and precisely into a laboratory apparatus. During storing and handling, the microfluidic chip can be protected by the frame against possible damage.

Further embodiments comprise a microfluidic chip with at least one inlet port and at least one microfluidic channel, in particular for usage with a laboratory apparatus. The microfluidic chip can comprise at least one spring. Advantageously, the chip can be moved against the restoring force of the spring to simplify the handling of the microfluidic chip.

In a preferred embodiment the spring of the microfluidic chip is used to move the chip from a second operating position back to a first non-operating position automatically after use. In the non-operating position it is possible to protect the chip and its sensitive parts automatically after use.

In another advantageous embodiment the spring is built of a plurality of patterned recesses in the material of the microfluidic chip. The recesses can be punched or cut directly into the chip in an easy and a cost-saving way. Additional parts are not needed. The material of the chip is elastic and builds the spring itself.

Finally, an advantage of embodiments of the present invention is the use of a miniaturized microfluidic device with a frame and with a microfluidic chip. Advantageously, the device is fed or better inserted into a laboratory apparatus. Because of its frame the device can be handled without endangering sensitive parts of the microfluidic chip and can be positioned exactly in the laboratory apparatus. After that the sensitive microfluidic chip is brought safely and precisely relative to the frame from a first position to a second position. The exact positioning of the chip in regard to the frame and due to this also to the laboratory apparatus is made possible.

Embodiments of the invention can be partly or entirely embodied or supported by one or more suitable software programs, which can be stored on or otherwise provided by any kind of data carrier, and which might be executed in or by any suitable data processing unit. Software programs or routines are preferably applied for maintaining the device and/or the microfluidic chip. Therefore the frame comprises an identification-tag, in particular a radio frequency chip. The chip can be programmed and read out by a transponder system connected with the data processing unit. In particular, a counter to count the amount of analyzed samples with the microfluidic chip is implemented in the radio frequency chip.

BRIEF DESCRIPTION OF DRAWINGS

Other objects and many of the attendant advantages of embodiments of the present invention will be readily appreciated and become better understood by reference to the following more detailed description of preferred embodiments in connection with the accompanied drawings. Features that are substantially or functionally equal or similar will be referred to with the same reference signs.

DETAILED DESCRIPTION OF THE PREFERRED EMBODIMENTS

Figure 1:
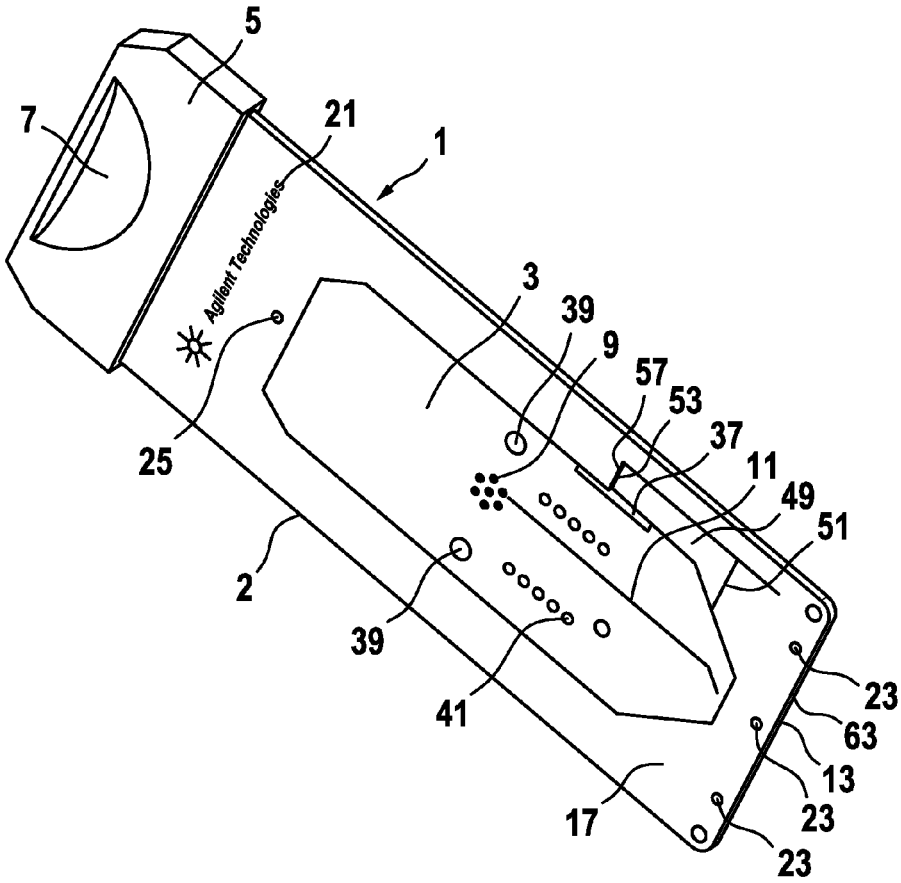
FIG. 1 shows a three-dimensional view of a miniaturized microfluidic device with a space frame, a handle, and an asymmetric microfluidic chip inside.

FIG. 1 shows a three-dimensional view of a microfluidic device 1 comprising a frame 2 for a microfluidic chip 3 with a handle 5. The handle 5 comprises a half circular recess 7 for better manual handling of the frame 2. In a preferred embodiment the frame 2 or the handle 5 comprises not shown means, for example holes, pins or like, for interacting with an automatic gripper. The not shown gripper can also interact with the half circular recess 7 of the handle 5.

The frame 2 of the device 1 can be inserted manually or by the gripper together with the microfluidic chip 3 into a not shown laboratory apparatus, for example a mass spectrometer.

The microfluidic chip 3 comprises at least one microfluidic inlet port 9, symbolized by some dots and at least one microfluidic channel 11.

Figure 2:
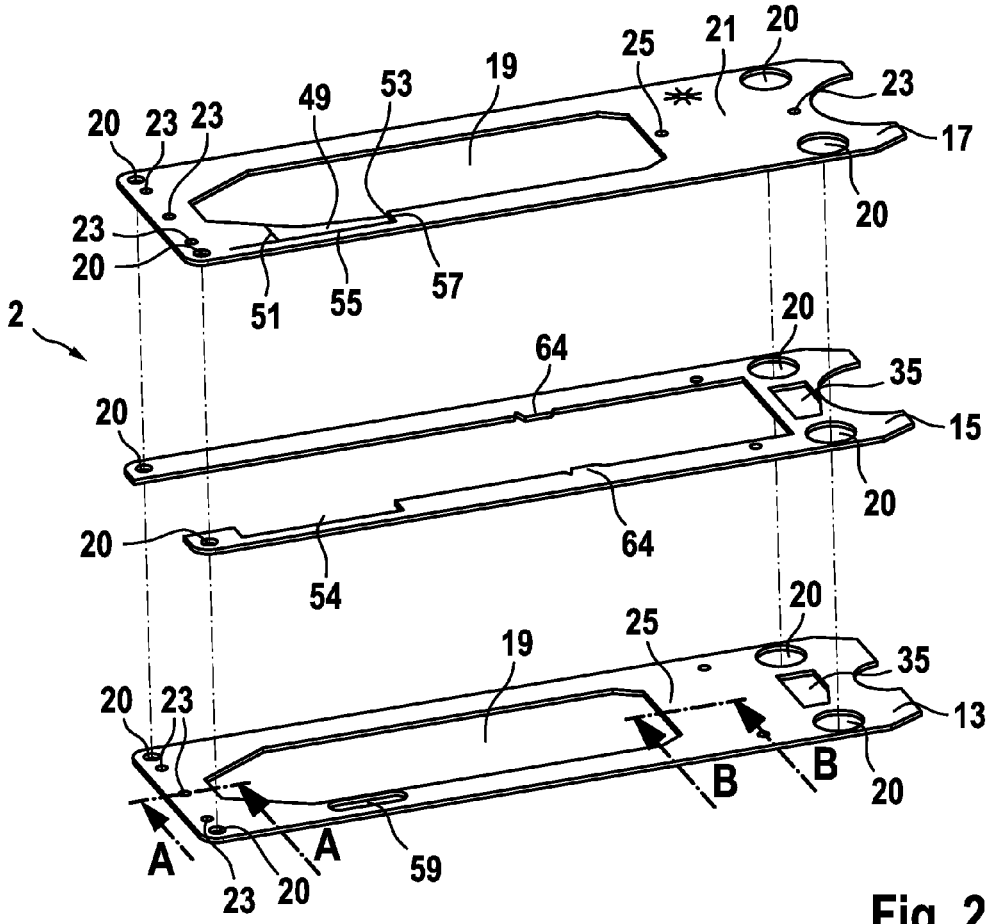
FIG. 2 shows a three-dimensional exploded view of the device of FIG. 1, but without the handle and microfluidic chip.

FIG. 2 shows a three-dimensional exploded view of the frame 2 of FIG. 1, but without the handle 5 and without the microfluidic chip 3. The frame 2 is build as a space frame comprising a bottom layer 13, a middle layer 15, and a top layer 17. The middle layer 15 determines the height of the frame 2 and the space left between the layers 13 and 17 for the microfluidic chip 3. Simply by changing the middle layer 15 the frame can be adapted to microfluidic chips of different thicknesses. The layers 13 and 17 each comprise a window 19. The microfluidic chip 3 inserted into the assembled frame 2 is easily accessible through the windows 19 of the layers 13 and 17 as also illustrated in FIG. 1.

In a preferred embodiment the frame 2 and its layers 13, 15, 17 consist of metal. They may also comprise foil, laminate, plastic or any other suitable material. The layers can be produced by stamping, laser or water jet cutting, die-casting, etching, or alike. The layers 13, 15, 17 can be glued together or can be fixed by screws, rivets, laser welding, or like and according holes 20 of any size. Additionally the handle 5 can be fixed to the frame 2 by on ore more of the holes 20. The frame 2 can have more or less than 3 layers.

It is to be understood that, throughout this description, wherever the term 'die-casting' is used, injection molding can be applied accordingly.

Figure 3:
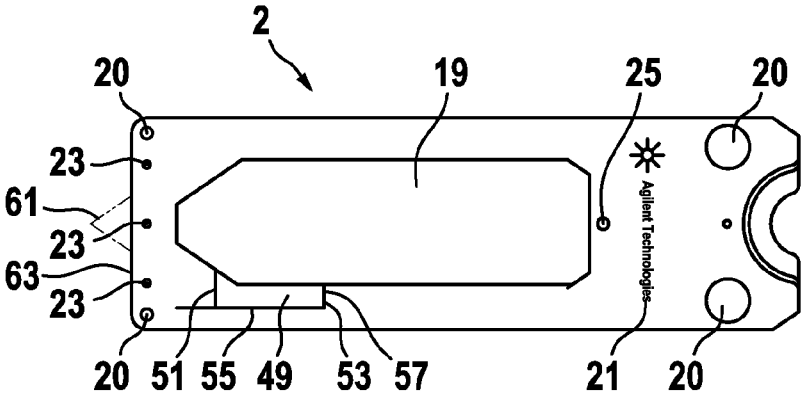
FIG. 3 shows a top view of the device of FIG. 2.

FIG. 3 shows a top view of the frame 2. Advantageous the frame 2 can be labeled with a logo 21, a bar code, a color code, a blank label to be marked manually or like. In the embodiment shown in the FIGS. 1 to 3 the top layer 17 of the frame 2 comprises the logo 21.

Figure 2A:
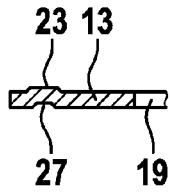
FIG. 2A shows a schematic cross-sectional view of a bottom layer of the device of FIG. 2, taken along the lines A-A of FIG. 2.
Figure 2B:
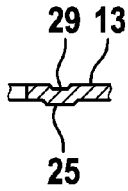
FIG. 2B shows a schematic cross-sectional view of the bottom layer of the device of FIG. 2, taken along the lines B-B of FIG. 2.

FIG. 2A shows a schematic cross-sectional view of the bottom layer 13 of the frame 2 of the device 1 of FIG. 2 with the spacing nose 23, taken along the lines A-A of FIG. 2;

FIG. 2B shows a schematic cross-sectional view of the bottom layer of the device of FIG. 2 with the locking nose 25, taken along the lines B-B of FIG. 2;

The layers 13 and 17 each comprise three or four spacing noses 23 and one locking nose 25. The noses 23 and 25 can be produced by forming blind holes 27 and 29 in the layers 13 and 17. It is also possible to produce them in any other way, for example by riveting, screwing, and gluing additional parts to the layers 23 and 25 or like. The blind hole 29 of the locking nose 25 is deeper than the blind hole 27 of the spacing nose 23.

Figure 4:
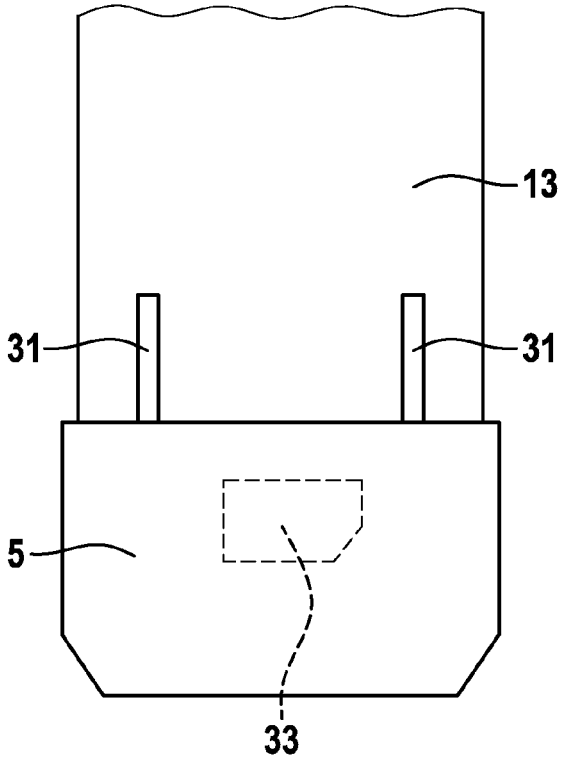
FIG. 4 shows a schematic partly bottom view of the device of FIG. 1.

FIG. 4 shows a schematic bottom view of a part of the frame 2. In a preferred embodiment the frame 2 or the handle 5 of the frame 2 comprises at least one rib 31. Shown are two ribs 31. The ribs 31 can interact with means of the laboratory apparatus not illustrated in here. The top side of the frame is different compared to its bottom side. Consequently the frame 2 can only be fed into the laboratory apparatus in one correct way.

Illustrated with dotted lines is a radio frequency chip 33 inside the handle 5 of the frame 2 of another embodiment. The radio frequency chip 33 can realize an identification-tag. The radio frequency chip 33 can be programmed and read out by a transponder system connected with a data processing unit. In particular, the tag 33 can hold data for maintenance, diagnostic and configuration purposes and/or a counter to count the amount of analyzed samples with the microfluidic chip is implemented in the radio frequency chip 33. In a preferred embodiment the radio frequency chip 33, the microfluidic chip 3 and the frame are not separable. This can avoid any manipulation of the counting and maintaining process. The handle 5 comprises the radio frequency chip 33. It lays inside the handle 5 in two openings 35 of the bottom layer 13 and the middle layer 15 and is spaced from the top layer 17 by the spacing nose 23 (FIG. 2).

Figure 5:
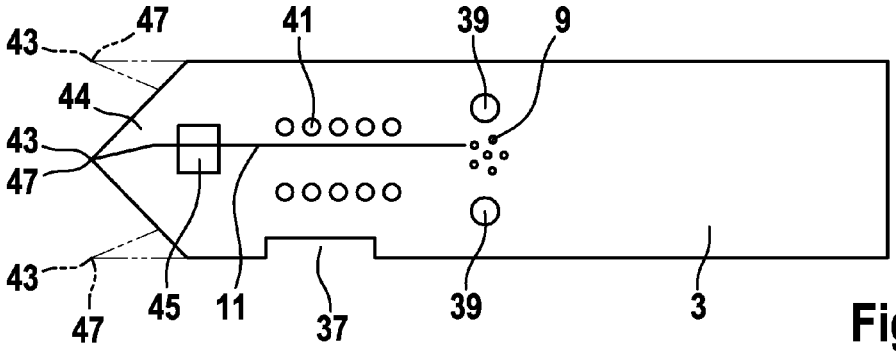
FIG. 5 shows the microfluidic chip of FIG. 1.

FIG. 5 shows the microfluidic chip 3 of FIG. 1 but without the frame 2. The chip 3 is asymmetric because of a rectangular recess 37 at one of its sides. In this embodiment the microfluidic chip 3 comprises at least two alignment or gripping holes 39, to interact with, for example, an automatic gripper or another instrument suitable for gripping and aligning the microfluidic chip 3, 10 electrical contacts 41 and at least one outlet port 43 for the microfluidic channel 11. Of course, more or less than 10 electrical contacts 41 can be foreseen. Two more optional outlet ports 43 are indicated with dotted lines. The microfluidic channel 11 connects the inlet port 9 sited approximately in the middle of the microfluidic chip 3 with the outlet port 43 sited at the front end 44 of the microfluidic chip 3. The microfluidic chip 3 can have more than one channels or a complex system of channels to connect the other ports 9 and 43 of the microfluidic chip 3. For analyzing or separation it is possible to press liquid through the port 9—into the chip 3—and into the channel 11. Therefore the microfluidic chip 3 can also have a detection area. The channel 11 crosses the detection area 45. The liquid being inside the channel 11 can be analyzed by optical means sited close to the chip 3 through the detection area 45. For this purposes the detection area is at least partly transmissible.

The length of the microfluidic chip 3 in this embodiment is longer than necessary. Functional elements are only installed between the front end 44 and the holes 39 of the microfluidic chip 3. The microfluidic chip 3 is longer than necessary and adapted to the frame 2. Advantageously, it is easier to extend and adapt the length of the microfluidic chip 3 to the length of one kind of frames than opposite. The microfluidic chip 3 can comprise additionally microfluidic devices like reactors or alike.

If the microfluidic chip 3 is used to separate the components of the liquid, the liquid is pressed through the channel 11 towards one of the outlet ports 43 and sprayed into a laboratory apparatus, which can be a mass spectrometer for example. The outlet port 43 or better the front end 44 of the microfluidic chip 3 is designed as a micro spray tip 47. The spray tip 47 is very sensitive and has to be protected against any damage, which could be caused by touching or like.

Referring to the FIGS. 1 to 5 it is described how the device 1 or better the frame 2 for the microfluidic chip 3 prevents the spray tip 47 from any undesirable damage. This results in an improved and save method for handling, storage, and transport.

If the microfluidic chip 3 is not used, a locking pawl 49 of the top layer 17 is engaged with the recess 37 of the microfluidic chip 3. The pawl 49 can lock the microfluidic chip 3 until actual usage. The locking pawl 49 is inclined or respectively bent at an edge 51 from the top layer 17 towards the bottom layer 13 of the frame 2. The pawl 49 comprises an end 53, which is in contact with the bottom layer 13, engaged in a recess 54 of the middle layer and under slight tension. The longitudinal sides of the pawl 49 are adjacent to a first recess 55 of the top layer 17 and the window 3. The end 53 of the pawl 49 is adjacent to a second recess 57 of the top layer 17. The recesses 55 and 57 can be punched or cut, for example by laser, etching, or water jet cutting, in the material of the top layer 17. The pawl 49, which is a leave spring with one leave, is engaged in the recess 37 of the microfluidic chip 3 and locks it in a first non-operating position. The pawl 49 is consequently part of a first lock 50 for keeping the chip 3 in its first position. In this first non-operating position the microfluidic chip 3 cannot be moved relatively to the frame 2. Advantageously, the pawl 49 opens itself when the chip 3 is inserted firstly into the frame 2 and locks after inserting the chip 3 automatically in the first position. Because of the recess 37 the chip 3 can only be locked if it is inserted into the frame 2 in one correct way. The frame 2 or the chip 3 may have a mechanism or means, for example another recess and a pin, for guaranteeing that the chip 3 can only be fed into the frame 2 in one correct way.

For bringing the microfluidic chip 3 in a second position, which can be an operating position, the pawl 49 must be opened by an opening mechanism, which can be a pin not shown here. The opening mechanism can be actuated manually or automatically. The pin can be inserted into an asymmetric elongated hole 59 of the bottom layer 13 and move the pawl 49 or respectively the end 53 of the pawl 49 against a restoring force towards the top of the frame 2 out of the recess 37 of the microfluidic chip 3. In this position the pin can be engaged in the recess 37 of the microfluidic chip 3 to determine the possible movements along the longitudinal axis of the frame 2 of the chip 3 according to the length of its recess 37. The pin can lock the chip 3 in the second position.

The frame can have a second sock 60 for locking the chip at the second position. The second lock avoids separating the microfluidic chip 3 and the frame 2. The second lock can comprise a pin, a screw, a rivet or alike which is for example engaged in the recess 37 of the chip 3. The second lock can be installed for example between two of the spacing noses 23 in two opposite holes—which are not illustrated—in the layers 13,17 to lock the front end 44 of the microfluidic chip 3 in the second position. To create the second lock, the top or the bottom layer 13, 17 can be deformed after inserting the microfluidic chip 3, for example by forming or installing a nose similar to the noses 23, 25.

If the first lock respectively the pawl 49 is released, the microfluidic chip 3 can be moved relatively to the frame 2 for bringing it in the second position. The second position is symbolized by a dotted line 61 in FIG. 3. The microfluidic chip 3, in particular its spray tip 47, is moved partly out of the frame 2 through a rectangular front slot 63 of the frame.

In another embodiment the microfluidic chip 3 is removable from the frame 2 respectively changeable. The frame 2 can be used consequently for more than one microfluidic chip 3.

The microfluidic chip 3 is guided by the spacing noses 23, which rise right-angled to the inner surface of the frame 2 in the front slot 63. In the first position the spray tip 47 lies in the area of the adjacent noses 23. The noses 23 avoid any touching of the spray tip with the inner surface of the frame 2.

To operate the microfluidic chip 3 inside a laboratory apparatus, the opening mechanism can be integrated in the apparatus.

In a first step the frame 2 of the device 1 can be fed into a laboratory apparatus and can be locked therein by the locking noses 25 rising right-angled to the outer surface of the frame 2. For locking the frame 2 inside the laboratory apparatus, the locking noses 25 can be gripped by a mechanism. Then the pawl 49 is opened, for example by a pin. Subsequently the microfluidic chip 3 can be gripped manually or by a not shown gripper, for example by gripping the chip 3 at its gripping holes 39. Then the microfluidic chip 3 can be moved in direction of its longitudinal axis relatively to the frame 2 from the first non-operating position to the second operating position. The middle layer 15 comprises two opposite shoulders 64 for guiding the chip 3 inside the frame 2. The frame 2 can be provided with only one guiding shoulder or more than two. For changing the position the shoulders can guide the chip 3 at its longitudinal sides.

The operating position is determined by the relative position of the spray tip 47 to the laboratory apparatus. It is possible to reach this operating position only by removing the frame 2 without any movement of the chip 3 relative to the laboratory apparatus. In the second position the spray tip 47 is released and can be positioned exactly inside the laboratory apparatus. To spray liquid inside the apparatus at least one of the ports 9 has to be connected to a means for pumping or charging the liquid, which can be part of the laboratory apparatus. For a chromatography or an electrophoresis process for the spraying process the microfluidic chip 3 can be laid at least to on electrical potential by connecting at least one of the electrical contacts 41 to a power supply.

To avoid noise voltage the frame 2 can be connected to the ground and can advantageously comprise a conductive material, such as metal or conductive rubber, or can comprise a conductive surface coating.

Figure 6:
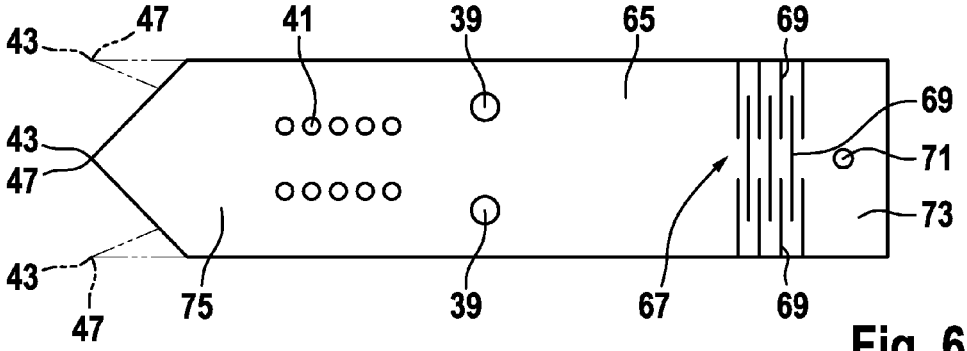
FIG. 6 shows a symmetric microfluidic chip with an integrated spring.

FIG. 6 shows an embodiment with a symmetric microfluidic chip 65 with an integrated spring 67.

The spring 67 is built of a plurality of patterned recesses 69 in the material of the microfluidic chip 65.

Figure 6A:
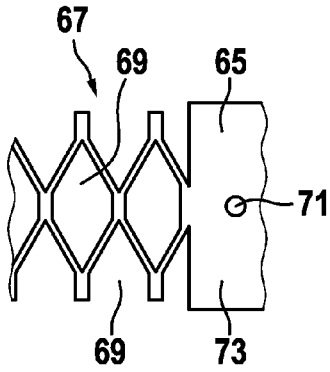
FIG. 6A shows a detail view of the microfluidic chip of FIG. 6 with elongated spring.

FIG. 6A shows a detail view of the microfluidic chip 65 of FIG. 6 with the elongated spring 67;

The microfluidic chip 65 comprises two kinds of recesses 69 placed in an alternating manner. They are sited right-angled in respect to the longitudinal axis of the microfluidic chip 65 and parallel to each other. One type is in the middle of the microfluidic chip 65 and the other kind reaches to the side rims of the microfluidic chip 65.

The microfluidic chip 65 can be coupled with the frame 2. Therefore, the microfluidic chip 65 can be fixed in the frame 2 by a hole 71 at an inside end 73 of the microfluidic chip 65. A distal end 75 can be moved relatively to the frame 2 as described above. Advantageously, the distal end 75 is removed back in the non-operating position automatically by the restoring force of the spring 67.

Figure 7:
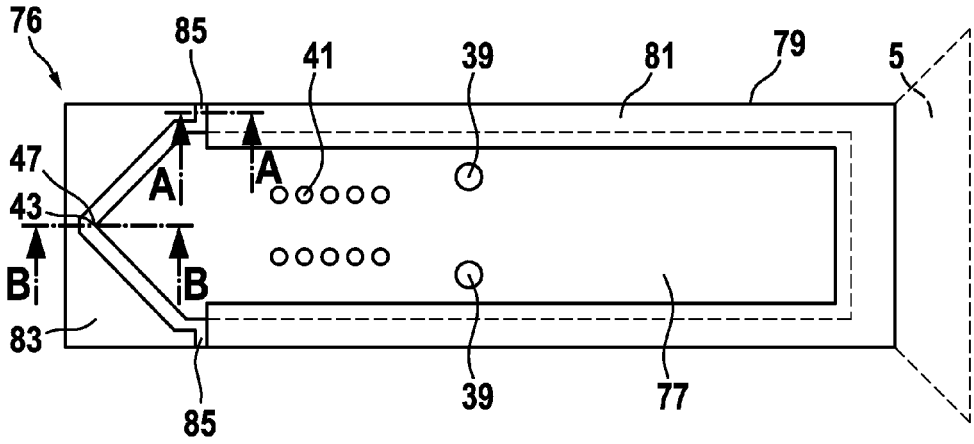
FIG. 7 shows a miniaturized microfluidic device with a microfluidic chip, with a partly die-cast coating and with a protection flap.

FIG. 7 shows a miniaturized microfluidic device 76 with a microfluidic chip 77, with a frame 79 comprising a partly pressure die-cast coating 81, and with a protection flap 83.

Figure 7A:
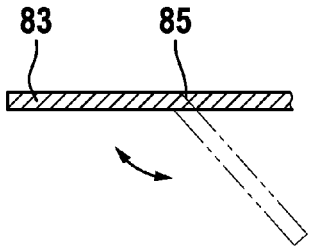
FIG. 7A shows a cross-sectional view of the device of FIG. 7, taken along the lines A-A of FIG. 7.

FIG. 7A shows a cross-sectional view of the device 76 of FIG. 7, taken along the lines A-A of FIG. 7.

Figure 7B:
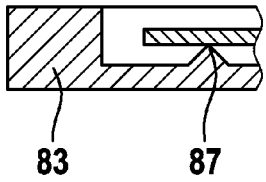
FIG. 7B shows a cross-sectional view of the device of FIG. 7, taken along the lines B-B of FIG. 7.

FIG. 7B shows a cross-sectional view of the device 76 of FIG. 7, taken along the lines B-B of FIG. 7.

The flap 83 is hinged at the device 76 by an integral hinge 85. To uncover the spray tip 47 of the microfluidic chip 77 or to bring it in working position, the flap 83 can be hinged to an axis right angled to the longitudinal axis of the microfluidic chip 77 as shown in FIG. 7A. The protection flap can also be hinged to any other axis, for example to an axis parallel to the longitudinal axis of the frame 79.

The frame 79 respectably the die-cast coating 81 is not separable from the microfluidic chip 77. Advantageously, this complicates or prevents reverse engineering.

The flap 83 comprises a spacing nose 87 with the same protection for the spray tip 47 as described above. The nose 87 is rising towards the microfluidic chip 77 in the area of its spray tip 47 if the flap 83 is hinged towards the microfluidic chip 77 as shown in FIG. 7B.

The frame 79, the hinge 85, and the coating 81 can be produced by die-casting.

Figure 8:
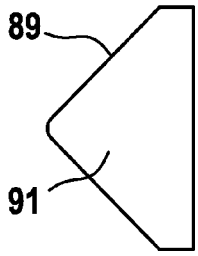
FIG. 8 shows a top view of a feeder for the die-casting process of the device of FIG. 7.

FIG. 8 shows a top view of another embodiment with a feeder 89 forming a part of the flap 83 and the nose 87 for this die-cast process of the device of FIG. 7.

Figure 9:
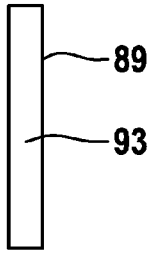
FIG. 9 shows an inner view of the feeder of FIG. 8.

FIG. 9 shows a schematic inner view of the feeder 89 of FIG. 8.

The feeder 89 has a blind hole 91 in order to form the nose 87 of the flap 83. During the die-cast process the distal end 75 and the spray tip 47 are moved partly into a slot of the feeder 89. Thus the spray tip 47 is protected during die-casting.

Figure 10:
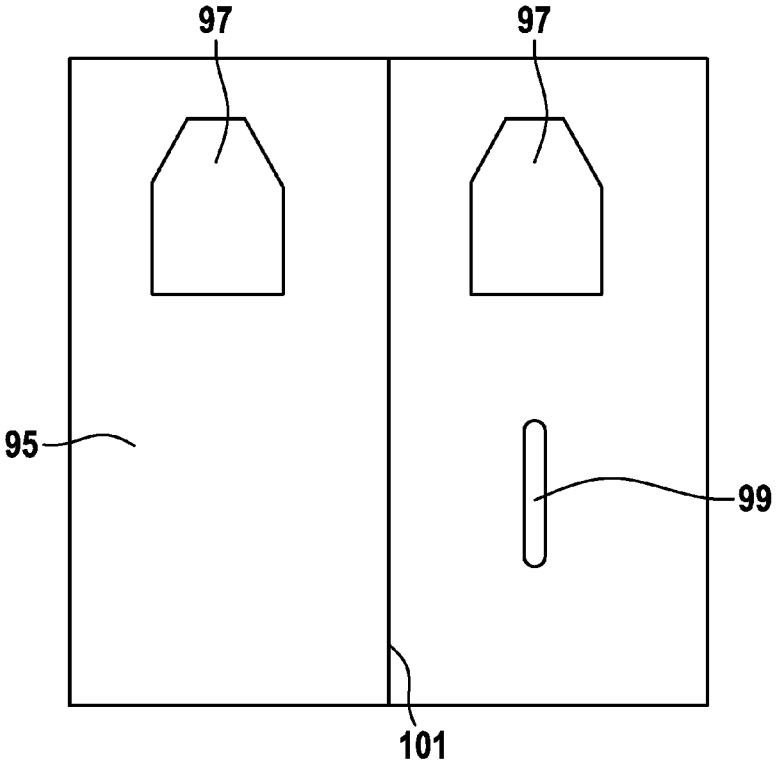
FIG. 10 shows a solid and foldable frame for a microfluidic chip.

FIG. 10 shows another embodiment with a solid and foldable frame 95 for a microfluidic chip 3. Compared to the frame 2 the frame 95 consists only of one single part, which may be also produced by pressure die-casting. The frame 95 has two smaller windows 97 and an elongated hole 99 for the gripping mechanism. This frame 95 can contain smaller microfluidic chips 3 and can be closed or opened by folding it at a middle hinge 101. The middle hinge 101 can be an integral hinge. For assembling the frame 95, it can be folded and locked by a locking mechanism. Instead of locking the frame 95, it can be glued together, sealed, for example by ultrasonic welding or heat sealing.

Figure 11:
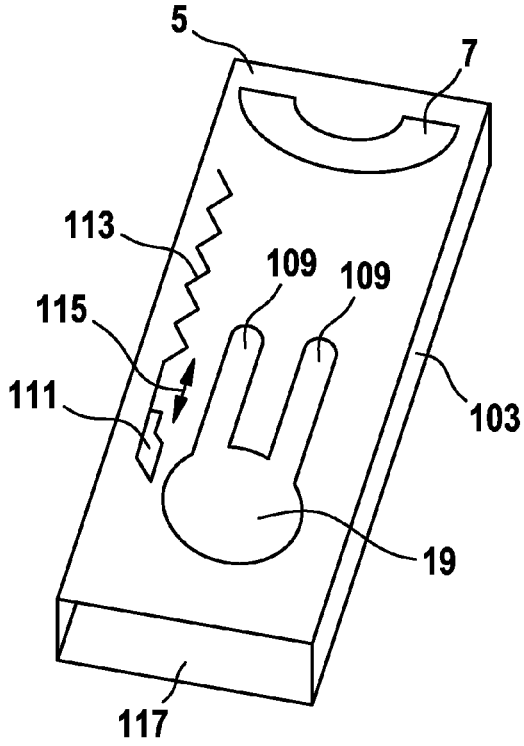
FIG. 11 shows a three-dimensional schematic view of a frame for receiving a microfluidic chip embedded in a cartridge.
Figure 12:
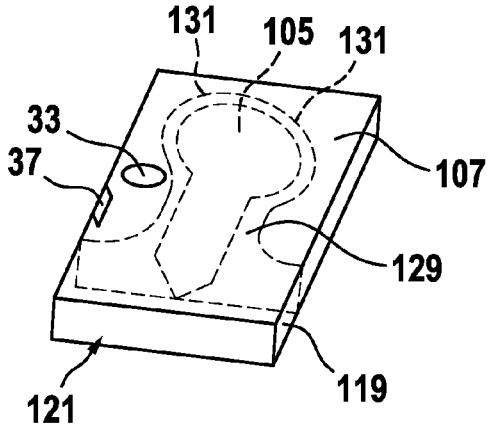
FIG. 12 shows a three-dimensional schematic view of the microfluidic chip embedded in the cartridge fitting into the frame of FIG. 11.
Figure 13:
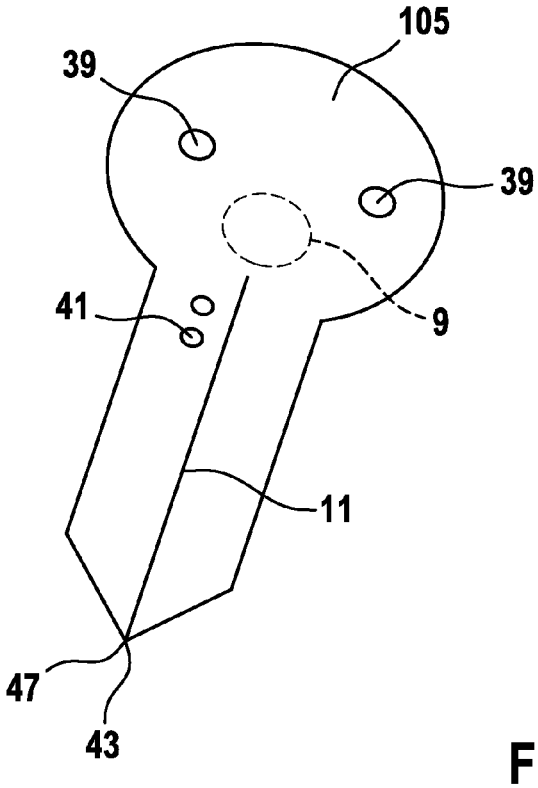
FIG. 13 shows a three-dimensional schematic view of the microfluidic chip of FIG. 12, but without the cartridge.
Figure 14:
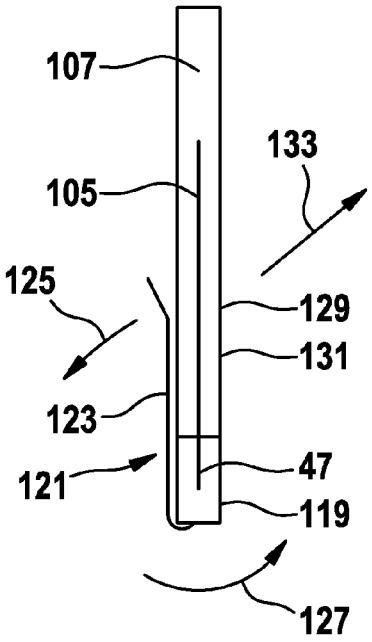
FIG. 14 shows a schematic side view of the cartridge of FIG. 12 with the microfluidic chip of FIG. 13.

FIG. 11 to 18 show a further embodiment of a frame 103 adapted for receiving a microfluidic chip 105 embedded in a cartridge 107. The design of the frame 103 is described in the following by referring to the FIG. 11 to 14:

FIG. 11 shows a three-dimensional schematic view of the frame 103;

FIG. 12 shows a three-dimensional schematic view of the microfluidic chip 105 embedded in the cartridge 107 fitting into the frame 103 as shown in FIG. 11;

FIG. 13 shows a three-dimensional schematic view of the microfluidic chip 105 as shown in FIG. 12, but without the cartridge 107;

FIG. 14 shows a schematic side view of the cartridge 107 as shown in FIG. 12 with the embedded microfluidic chip 105 as shown in FIG. 13;

The frame 103 comprises two elongated holes 109 leading to a circular window 19 of the frame 103 for accessing the chip 105 within the cartridge 107. A not shown gripping mechanism can actuate the cartridge 107 together with the chip 105 by gripping two gripping holes 39 of the microfluidic chip 105. The frame 103 can receive the cartridge 107 and realizes a slide bearing for the cartridge 107 within the frame 103. The cartridge 107 and consequently the embedded microfluidic chip 105 can be positioned relative to the frame 103 by sliding the cartridge 107 within the frame 103.

The frame 103 can comprise a fixing element for the cartridge 105. FIG. 11 shows the frame 103 with a catch 111 combined with a longitudinal return spring 113. The return spring 113 is parallel to the direction of the degree of freedom of the slide bearing for the cartridge 107 within the frame 103 as indicated with a double arrow 115. One end of the return spring 113 is coupled with the frame 103 and the other end of the spring 113 located close to a front opening 117 of the frame 103, wherein the other end of the spring 113 is coupled with the catch 111.

Before using the microfluidic chip 105, the cartridge 107 can be inserted through the front opening 117 of the frame 103 into the frame 103. After inserting the cartridge 107 into the frame 103, the catch 111 of the frame 103 engages with a recess 37 of the cartridge 107. The catch 111 and the recess 37 realize a lock to interact with the frame 103 for keeping the cartridge 107 in a first position, in particular in a non-operating position.

The restoring force of the return spring 113 can be transferred from the frame. 103 to the cartridge 107 via the catch 111 engaged with the recess 37 of the cartridge 107. This makes it possible, that the cartridge 103 and consequently the microfluidic chip 105 is moved automatically in the non-operating position within the frame when the microfluidic chip 105 is not used. The sensitive spray tip 47 of the microfluidic chip 105 can be protected during handling, storage, and transport. The frame 103 can be touched and stored without destroying the sensitive spray tip 47 of the microfluidic chip 105.

The frame 103 can receive arbitrary cartridges 107. The microfluidic chip 105 can be coupled with the cartridge 107. Advantageously, the cartridge 107 can protect the microfluidic chip 105 during handling, storage, and transport. Therefore, the cartridge 107 can comprise a removable protection cap 119, for example realizing a tamper-evident closure 121 for completely covering at least all sensitive parts of the microfluidic chip 105. The tamper-evident closure 121 of the cartridge 107 for protecting the microfluidic chip 105 can comprise a removable self-adhesive plastic sheeting 123. For uncovering the spray tip 47 of the microfluidic chip 105, the self-adhesive plastic sheeting 123 and the protection cap 119 can be removed completely as illustrated in FIG. 14 as follows:

Firstly, the self-adhesive plastic sheeting 123 can be removed in direction of an arrow 125. The protection cap 119 can be coupled with the self-adhesive plastic sheeting 123. Therefore, subsequently, the protection cap 119 can be removed in direction of an arrow 127 simply by gripping the self-adhesive plastic sheeting 123 or the protection cap 119 and moving the protection cap 119 in direction of the arrow 127. Finally, the self-adhesive plastic sheeting 123 and the protection cap 119 can be removed completely together with a window part 129 as indicated with an arrow 133. The window part 129 is coupled with the cartridge 107 via a perforation 131 as indicated in the FIGS. 12 and 14 with dotted lines. Removing the window part 129 destroys the perforation 131 and opens a window 135 of the cartridge 107 for accessing the microfluidic chip 105.

The cartridge 107 can comprise at least one identification-tag, for example a radio-frequency-chip 33 as shown in FIG. 12. The radio-frequency-chip 33 can be fixedly assigned to the microfluidic chip via the cartridge 107.

Advantageously, the cartridge 107 can comprise a cheep plastic material compared to the material of the microfluidic chip 105. This makes it possible to save cost by minimizing the size of the microfluidic chip 105. The external dimensions of the cartridge 107 can be produced out of the cheep plastic material and can be standardized and adapted to the size of the frame 103. The cartridge 107 together with the microfluidic chip 105 can be designed as a wearing part, for example with standardized external dimensions. Therefore, the frame 103 can be designed reusable for a plurality of different cartridges 107. In a not shown embodiment, the cartridge 107 can comprise at least one not shown alignment hole.

FIG. 15 to 18 show schematic side views of the cartridge 107 of FIG. 12 with the microfluidic chip 105 as shown in FIG. 13 within the frame as illustrated in FIG. 11 in different positions together with a sealing plate 137 comprising two actuating pins 139, wherein in the FIG. 15 to 18 just one of the actuating pins 139 is visible.

Figure 15:
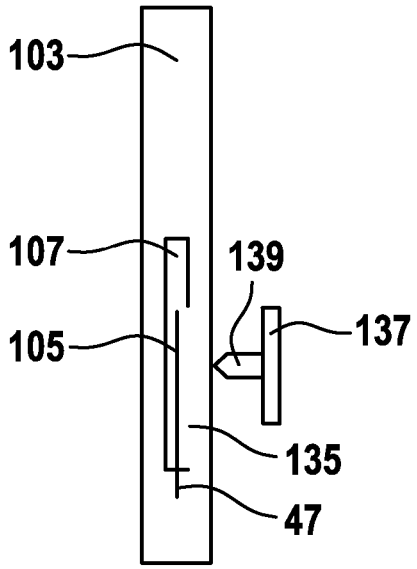
FIG. 15 to 18 show schematic side views of the cartridge of FIG. 12 with the microfluidic chip of FIG. 13 within the frame of FIG. 11 in different positions together with a sealing plate comprising an actuating pin.

FIG. 15 shows the cartridge 107 and the microfluidic chip 105 in the non-operating position, wherein the removable protection cap 119 and the tamper-evident closure 121 are removed completely. Therefore, the window 135 of the cartridge 107 is opened and the microfluidic chip 105 is accessible. In the position as illustrated in FIG. 15, the actuating pins 139 are facing the elongated holes 109 of the frame 103 and the gripping holes 39 of the microfluidic chip 105. The gripping holes 39 lay behind the elongated holes 109.

Figure 16:
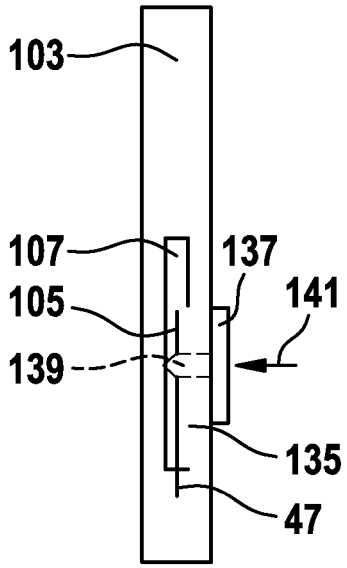

For gripping the microfluidic chip 105, the actuating pins 139 of the sealing plate 137 can be moved through the elongated holes 109 of the frame 103 into the gripping holes 39 of the microfluidic chip 105 in direction of an arrow 141 shown in FIG. 16.

Figure 17:
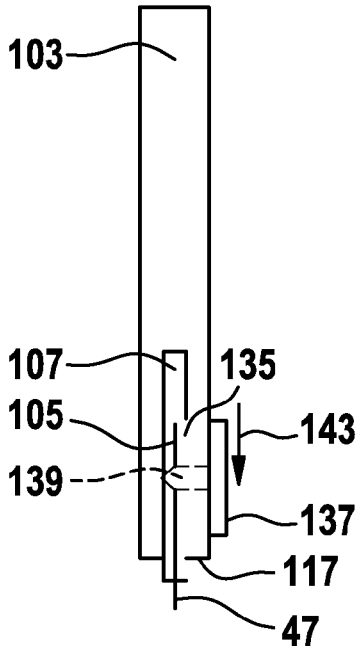

After gripping the microfluidic chip 105, the microfluidic chip 105 can be moved—in direction of the FIG. 17—downwards against the restoring force of the return spring 113 (not illustrated in FIG. 17) of the frame 103. The direction of movement is illustrated in FIG. 17 with an arrow 143. FIG. 17 shows the microfluidic chip 105 together with the cartridge 107 in an operating position, wherein the spray tip of the microfluidic chip 105 stands out of the front opening 117 of the frame 103.

Figure 18:
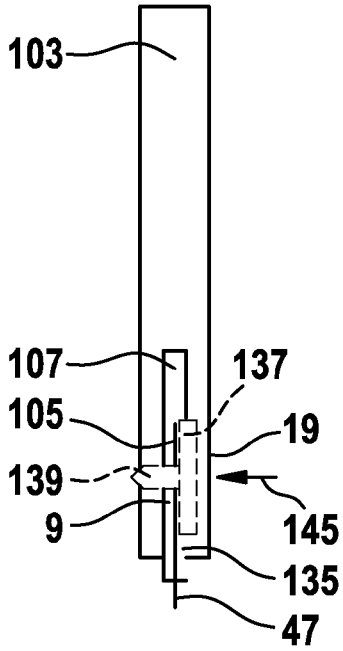

Finally, for sealing at least one inlet port 9 of the microfluidic chip 105, the sealing plate 137 can be moved through the window 19 of the frame 103 and the window 135 of the cartridge 107 towards the microfluidic chip 105 as indicated in FIG. 18 with an arrow 145. In the position as shown in FIG. 18, the sealing plate 137 can be pressed against the microfluidic chip 105 and against a not shown counter bearing behind the microfluidic chip 105 for sealing the inlet port 9 of the microfluidic chip 105.

The frames described above can receive any kind of microfluidic chips. Advantageously, the frames can receive chips comprising at least on sensitive part which has to be protected and/or chips which has to be positioned exactly in a laboratory apparatus.

In another embodiment the frame 2 can comprise a protection shield 70, which is movable lateral to the feeding direction of the device 1 into the laboratory apparatus. For bringing the chip 3 in the operating position, for example after or while feeding it to the laboratory apparatus, respectively to unprotect it, the shield can be removed manually or automatically by a mechanism.

In a further embodiment the device 1 is adapted to be stored in a storing rag.

In another embodiment the frame 2 and the microfluidic chip 3 are integrated in a banker's card with a thickness less than 1 mm. Devices like this can be sent easily by mail.

Besides this in an embodiment the device 1 or the frame 2 comprises a heat dissipation device for cooling the microfluidic chip 3.

Advantageously, the frame 2 is chemical resistant. By this any leakage of liquid can't cause any damage to the frame 2.

It is to be understood, that this invention is not limited to the particular component parts of the devices described or to process steps of the methods described as such devices and methods may vary. It is also to be understood, that different features as described in different embodiments, for example illustrated with different FIG., may be combined to new embodiments. It is finally to be understood, that the terminology used herein is for the purposes of describing particular embodiments only and it is not intended to be limiting. It must be noted, that as used in the specification and the appended claims, the singular forms of "a", "an", and "the" include plural referents until the context clearly dictates otherwise. Thus, for example, the reference to "an inlet port" or "an alignment hole" includes two or more such functional elements.

The invention claimed is:

1. A miniaturized microfluidic device, comprising:

a microfluidic chip comprising:

an inlet port configured for connecting to a laboratory apparatus;

an outlet spray tip protected by a frame; and a microfluidic channel connecting the inlet port and the outlet spray tip for analyzing or separating components of a liquid;

the frame receiving the microfluidic chip and configured to be used together with said laboratory apparatus, wherein said frame is further configured for permitting said microfluidic chip to be moveable relative to said frame.

2. The miniaturized microfluidic device of claim 1, wherein said frame is adapted for protecting said microfluidic chip.

3. The miniaturized microfluidic device of claim 1, wherein said frame comprises a first lock configured to interact with said microfluidic chip for keeping said microfluidic chip in a non-operating position.

4. The miniaturized microfluidic device of claim 3 wherein said first lock can be actuated by an opening mechanism to bring said microfluidic chip into an operating position of said microfluidic chip.

5. The miniaturized microfluidic device of claim 4, wherein said opening mechanism is an unlocking pin.

6. The miniaturized microfluidic device of claim 3, wherein said frame comprises a second lock to avoid separating said microfluidic chip and said frame.

7. The miniaturized microfluidic device of claim 1, wherein said microfluidic chip is removable from said frame.

8. The miniaturized microfluidic device of claim 1, wherein said frame includes a space frame comprising at least two layers.

9. The miniaturized microfluidic device of claim 8, wherein said space frame comprises a bottom layer, a middle layer, and a top layer, and wherein said middle layer of said space frame determines said space between said bottom layer and said top layer.

10. The miniaturized microfluidic device of claim 8, wherein at least one of said layers comprises a locking pawl configured to interact with a locking recess of said microfluidic chip, wherein said locking pawl and said locking recess are adapted for locking said microfluidic chip in a non-operating position of said microfluidic chip.

11. The miniaturized microfluidic device of claim 10, wherein a top layer comprises said locking pawl.

12. The miniaturized microfluidic device of claim 10, wherein said locking pawl is engaged with said recess of said microfluidic chip in said non-operating position of said microfluidic chip.

13. The miniaturized microfluidic device of claim 1, wherein said frame comprises a spring to move said microfluidic chip from an operating position to a non-operating position after use.

14. The miniaturized microfluidic device of claim 1, wherein said frame is fixed to an inside end of said microfluidic chip and said microfluidic chip further comprises a spring configured to move a distal end of said microfluidic chip automatically from an operating position back to a non-operating position after use.

15. The miniaturized microfluidic device of claim 14, wherein said spring is provided by a plurality of patterned recesses into a material of said microfluidic chip.

16. The miniaturized microfluidic device of claim 1, wherein said frame comprises a protection flap fixed by a hinge.

17. The miniaturized microfluidic device of claim 16, wherein said protection flap is hinged right-angled to a feeding direction of said frame inserted into said laboratory apparatus.

18. The miniaturized microfluidic device of claim 1, wherein said frame comprises a locking nose for locking said frame into said laboratory apparatus.

19. The miniaturized microfluidic device of claim 1, wherein said frame comprises a protection shield which is laterally movable in a feeding direction of said frame inserted into said laboratory apparatus.

20. The miniaturized microfluidic device of claim 1, wherein said microfluidic chip comprises a spring built of a plurality of patterned recesses in a material of said microfluidic chip.

21. The miniaturized microfluidic device of claim 1, wherein said frame comprises a window for accessing said microfluidic chip.

22. The miniaturized microfluidic device of claim 1, wherein said frame is adapted for positioning said microfluidic chip relative to said frame.

23. The miniaturized microfluidic device of claim 1, wherein said frame comprises an identification-tag.

24. The miniaturized microfluidic device of claim 1, wherein said frame comprises a catch to interact with a recess for keeping said microfluidic chip in a non-operating position.

* * * * *